United States Patent [19]

Janiak et al.

[11] Patent Number: 4,854,940

[45] Date of Patent: Aug. 8, 1989

[54] METHOD FOR PROVIDING IMPROVED SOLID FUELS FROM AGGLOMERATED SUBBITUMINOUS COAL

[75] Inventors: Jerzy S. Janiak; Ali A. Turak; Wanda Pawlak; Boleslaw L. Ignasiak, all of Edmonton, Canada

[73] Assignee: Electric Power Research Institute, Inc., Palo Alto, Calif.

[21] Appl. No.: 156,541

[22] Filed: Feb. 16, 1988

[51] Int. Cl.[4] ..... C10L 5/00

[52] U.S. Cl. ..... 44/620; 44/627

[58] Field of Search ..... 44/620, 502, 608, 545, 44/626, 627

[56] References Cited

U.S. PATENT DOCUMENTS

| | | | |
|---|---|---|---|
| 1,574,174 | 2/1926 | Schoch | 44/608 |
| 3,754,876 | 8/1973 | Pennington et al. | 44/620 |
| 3,957,456 | 5/1976 | Verschuur | 44/10 E |
| 3,985,516 | 10/1976 | Johnson et al. | 44/608 |
| 4,144,033 | 3/1979 | Nakako et al. | 44/620 |
| 4,153,419 | 5/1979 | Clayfield et al. | 44/23 |
| 4,209,301 | 6/1980 | Nicol et al. | 44/24 |
| 4,234,320 | 11/1980 | Verschuur | 44/23 |
| 4,249,910 | 2/1981 | Masologites et al. | 44/1 SR |
| 4,261,699 | 4/1981 | Sun et al. | 44/15 R |
| 4,295,858 | 10/1981 | Sun et al. | 44/1 SR |
| 4,360,422 | 11/1982 | Oka et al. | 209/5 |
| 4,396,396 | 8/1983 | Mainwaring | 44/24 |
| 4,412,839 | 11/1983 | Taylor | 44/1 B |
| 4,415,335 | 11/1983 | Mainwaring et al. | 44/1 C |
| 4,514,912 | 5/1985 | Janusch et al. | 44/608 |
| 4,575,418 | 3/1986 | Robbins | 209/3 |
| 4,601,729 | 7/1986 | Capes et al. | 44/51 |
| 4,705,533 | 11/1987 | Simmons | 44/545 |

FOREIGN PATENT DOCUMENTS

| | | |
|---|---|---|
| 1216551 | 1/1987 | Canada . |

*Primary Examiner*—Carl F. Dees

*Attorney, Agent, or Firm*—Flehr, Hohbach, Test, Albritton & Herbert

[57] ABSTRACT

A method is provided for separating agglomerated subbituminous coal and the heavy bridging liquid used to form the agglomerates. The separation is performed by contacting the agglomerates with inert gas or steam at a temperature in the range of 250° to 350° C. at substantially atmospheric pressure.

4 Claims, 2 Drawing Sheets

METHOD FOR PROVIDING IMPROVED SOLID FUELS FROM AGGLOMERATED SUBBITUMINOUS COAL

The present invention relates to an improved method of separating subbituminous coal (agglomerates) into solid fuel made of de-oiled agglomerates and distillable liquid hydrocarbon fuel.

The process of agglomeration provides a method of collecting and retaining the finely divided carbonaceous part of an aqueous coal slurry in a form which can be readily separated from water and ash-forming impurities in the coal. When a hydrocarbon liquid, known as the bridging oil, is introduced into a water slurry of finely divided coal, the oil preferentially wets the carbonaceous coal fraction, which is substantially hydrophobic, and causes it to agglomerate. These agglomerates can then be separated from the hydrophilic mineral matter which remains in the aqueous phase. There is a particular problem, however, when attempting to both agglomerate subbituminous coals, which are poor quality fuels, and to separate the bridging oil from the coal. Depending on the type of heavy oil used as a bridging liquid, if more than approximately 10% of the bridging oil is unrecoverable, (i.e., remaining in the coal after oil recovery) then this consumed oil becomes a cost of performing the process, and in most instances becomes a consumable which renders the process commercially unfeasible.

In U.S. Pat. No. 4,415,335 there is disclosed a method for separating an agglomerated mixture of finely divided coal particles from the bridging liquid hydrocarbon comprising contacting the agglomerates with steam at temperatures in excess of 200° C. to separate the liquid hydrocarbon from the coal particles. Specifically disclosed is a process utilizing an agglomerating oil which is a light gas oil with a boiling range of 240° to 340° C. The particular type of feed coal is not disclosed. However, such a light oil is not suitable to serve as a bridging oil for a subbituminous coal.

Subbituminous coals may be agglomerated using bridging liquids incorporating heavy oils or mixtures of heavy and light oils, however the consumption of the bridging liquid is relatively high, i.e. from 12 to 25%, which precludes the application of such a process for commercial applications because of the cost of the oil.

There remains in the art, therefore, a need for a process which effectively agglomerates subbituminous coals, and which also allows for efficient recovery of the bridging oil so that oil consumption is reduced to a level whereby the complete agglomeration and separation process is commercially feasible.

It is thus an object of the present invention to provide a method for efficiently recovering oil from an agglomerate of heavy bridging oils and subbituminous coal.

It is yet another object of the present invention to provide a method for separating agglomerated subbituminous coal from heavy bridging oil whereby the recovered coal product is an improved fuel characterized by high calorific value, and low moisture absorption capacity.

These and other objects of the present invention will be readily apparent from the following description and appended claims.

SUMMARY OF THE INVENTION

The present invention provides a method for separating an agglomerated mixture of finely divided subbituminous coal and the heavy oil used in agglomeration process, to recover distillable oil and an improved solid fuel, comprising the step of contacting the agglomerates with steam or an inert gas at a temperature in the range of 250° to 350° C. at near atmospheric pressure, whereby the separated solid fuel contains less than about 7% by weight, and usually 3% and above, residual heavy oil and is characterized by significantly reduced moisture capacity. Recovery of the heavy oil will usually be about 45–80%.

DESCRIPTION OF THE INVENTION

Figure 1:
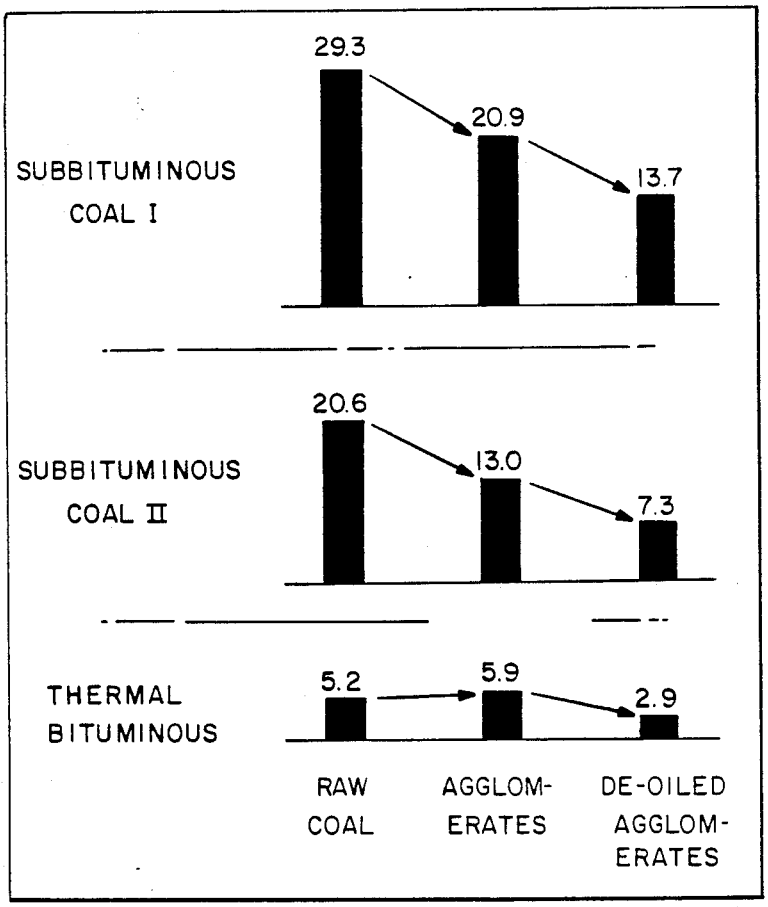
FIG. 1 is a graph showing the decrease in moisture capacities of two different subbituminous coals and a thermal bituminous coal attained first by oil agglomeration, then by de-oiling of the agglomerates according to the present invention.

The process of the present invention utilizes agglomerated subbituminous coal made by agglomerating such coal with a bridging liquid consisting essentially of from 20 to 50% of a light hydrocarbon diluent and from 50 to 80% of a low quality heavy oil. Thus, the ratio of heavy oil to light hydrocarbon diluent will be in the range of about 4:1–1:1. By the term light hydrocarbon diluent it is meant oils such as naphtha, kerosene, diesel oil and the like. By the term heavy oil it is meant bitumen, heavy crude, and other oils recognized in the art as heavy oils. Whereas a relatively small amount of bridging oil (as low as 2 to 5% by weight of coal) is normally utilized to agglomerate bituminous coals, to effectively agglomerate subbituminous coals a substantially larger amount of bridging oil is utilized, and may be in the range of from 12 to 25% by weight of coal.

A preferred process for forming agglomerates of subbituminous coals with a heavy oil bridging liquid and light hydrocarbon diluent is disclosed in Canadian Patent No. 1,216,551, issued Jan. 13, 1987, which is incorporated by reference herein in its entirety. Low rank subbituminous coals, as used herein, are defined as coals having a carbon content ranging from about 74 to 78% by weight (daf), (3.5 to 5.5% hydrogen (daf)) and a relatively high oxygen content, ranging from about 16 to 25% by weight (daf). Other characteristics of low rank subbituminous coals are a relatively high moisture content (about 10 to 30%), a high dry ash content (12 to 40%), volatile materials greater than 38% (daf), fixed carbon less than 62% (daf), 1 to 10% of oxygen in form of carboxyl group.

While the size of the agglomerates is not particularly critical to the present invention, in a preferred form, the subbituminous coal agglomerates will have a size of from about 0.6–30 mm.

A particularly preferred composition of bridging oil is an approximately 1:1 blend of heavy oil (such as Mayan oil) having a gravity in the range of 10–20° API and diesel oil. Alternatively, instead of heavy oil, a bitumen may be utilized having a gravity in the range of 5.5–10° API. In general, heavy oil, bitumen or any other low quality oil may be utilized as the bridging liquid. By low quality oils it is generally meant to include those oils having the following characteristics: API gravity from 7 to about 20; specific gravity (at 20° C.) of about 0.900 to 1.100; sulfur content from 2% to 5.0%, total solids (mg/l) in the range of 1 to 15; viscosity (cst at 40° C.) in the range of 3 to 500; and further characterized as being marginally distillable and generally having a high heteroatom and contaminant contents. The bridging oil may also be an emulsified product. When the bridging liquid is such an emulsion, the use of a light hydrocarbon diluent is usually not required. The agglomerates may then be introduced into a heating zone in any convenient manner known in the art at atmospheric pressure or under a slight vacuum (such as about 800 mbar). In the heating zone the agglomerates will be heated directly (by carrier gas) or indirectly, or both. The heating will result in generation of distillable oil and hardened agglomerates. The temperature within the heating zone will be in the range of 250° to 350° C. Utilizing a temperature higher than 350° C. usually results in lowering the volatile matter contents of the hardened agglomerates below acceptable level.

By extracting a heavy oil-bridged agglomerate of subbituminous coals in this manner, the moisture capacity of the resultant agglomerated particle is reduced at least by 5% (at a relative humidity of. 96%), whereas by thermal treatment of agglomerates of bituminous coal, moisture capacity of the resultant agglomerate is reduced only by about 3%.

Furthermore, it has been found that the solid fuel made in accordance with the invention contains less than 3 to 7% oil by weight (dry coal basis) and usually from 45–80 % of the initially used bridging oil is recovered. This particular aspect renders the agglomeration according to the present invention commercially feasible for subbituminous coals.

A test unit comprising a steam generator, inert gas supply, heating system and condensation and recovery section was constructed to test samples of agglomerates with various inert carriers at various temperatures. The steam generation is accomplished with a heating coil, immersed in a fluidized sand bath with a maximum operating temperature of 450° C. Water is pumped through this coil using a metering pump. The heating unit consists of a rotating glass reactor with baffles, heated by infrared radiation, under reduced pressure or positive pressure of inert gas carriers. A clamshell infrared oven with a water cooled jacket is utilized which may attain temperatures in the range of 200° to 900° C. in ½ to 3 minutes. The control is accomplished by a thermocouple placed in the sample bed. A glass reactor is rotated at various rates connected to multi-bulb cooler/condensor which rotates with it, being cooled by liquid nitrogen from the outside. Evolved gases are condensed in the glass cooler section, and the remaining gases are passed through a second condensor, active carbon trap and cold trap before being released or pumped into the vacuum pump. Weighed samples of agglomerates or raw coal samples (200 to 500 gms) are placed in the glass reactor and the whole assembly is placed into the oven reactor and attached to the Rotevap ®. While rotating, the reactor is purged with inert gas, and then oven fired. The heating rate is adjusted and maintained in comparative tests. The flowrate of carrier gas (or vacuum) is adjusted appropriately. The treatment is carried out at the desired temperature for a predetermined time and the contents of the reactor are quenched with cold carbon dioxide gas. After completion of the treatment both reactor and condensor contents are weighed. The condensor is then placed into the distillation setup and the water content of the condensate is determined by distillation with toluene. The amount of recovered oil is determined and % recovery is calculated by checking against the amount of oil taken for agglomeration.

A moisture capacity test was conducted utilizing two subbituminous coals and a bituminous coal by measuring the moisture capacity in each case of the raw coal, agglomerated coal, and de-oiled agglomerated coal according to the present invention. The results are shown in FIG. 1. The raw coals were tested for moisture capacity, then were tested as agglomerates, then as de-oiled coal made in the process in accordance with the present invention. As may be seen from FIG. 1, the combined effect of agglomeration and de-oiling according to the present invention, results, for subbituminous coal I and II, respectively, of a suppression of misture capacity of 15.6% units (i.e., a drop from 29.3% moisture capacity to 13.7%) and 13.3% units relative to the raw coal. However, for the bituminous coal, the moisture capacity suppression is 2.3% units (i.e., a drop from 5.2% moisture capacity to 2.9%).

Figure 2:
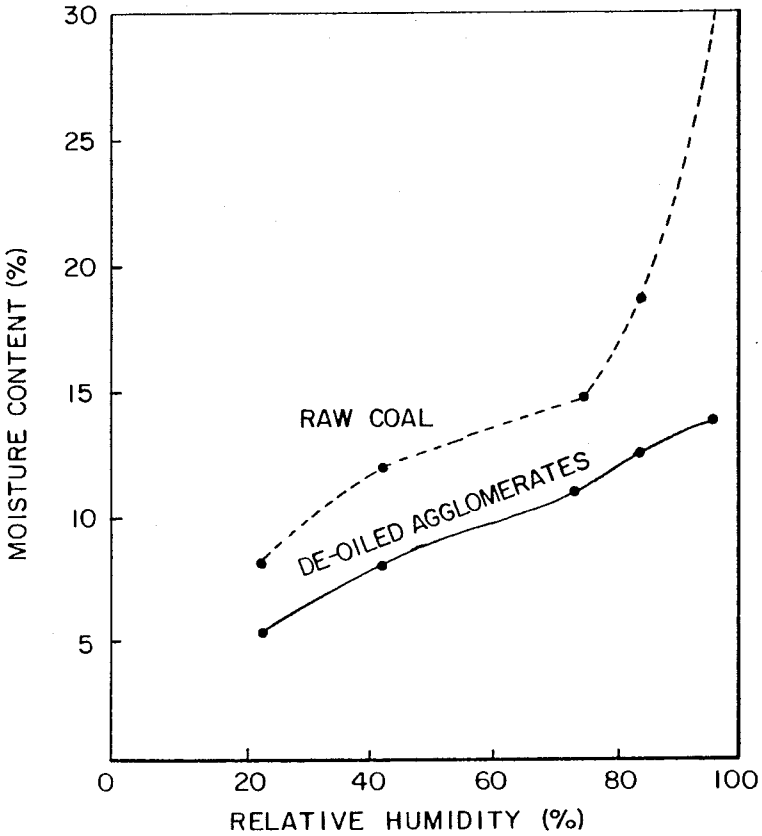
FIG. 2 is a graph of moisture content as a function of atmospheric relative humidity at 30° C. in a raw subbituminous coal (I, referred to in FIG. 1) and in de-oiled agglomerates thereof.

Referring to FIG. 2 there is shown a graph showing the moisture content (%) versus relative humidity at 30° C. in a raw coal (subbituminous coal I referred to above) and in a de-oiled agglomerate of that same coal. The moisture content for the de-oiled agglomerate was consistently over 2% units lower than that of the raw coal in the relative humidity range from 20% to about 70%. Due to rapid increase in moisture capacity of the raw coal after this point the difference between coal and deashed agglomerates is very significant.

Figure 3:
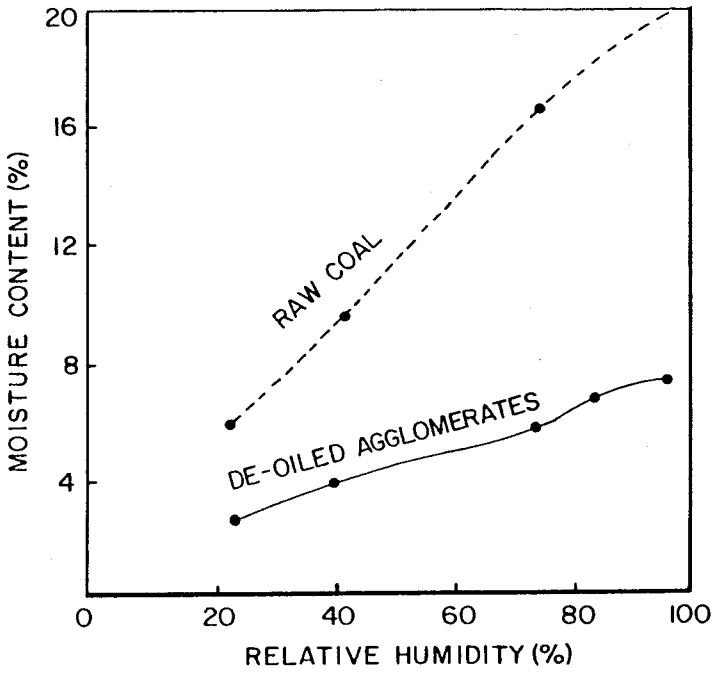
FIG. 3 is a graph of moisture content as a function of atmospheric relative humidity at 30° C. in a raw subbituminous coal (II, referred to in FIG. 1) and in de-oiled agglomerates thereof.

Referring to FIG. 3 there is shown the moisture content versus relative humidity at 30° C. in a subbituminous coal II (referred to above) and in a deoiled agglomerate made from that coal in accordance with the present invention. The moisture content of the de-oiled agglomerate was consistently lower than the moisture content of the corresponding raw coal. The difference significantly from 3% units . up to 13% units with relative humidity from 20%–96%.

In the following Tables 1, 2, and 3 there are shown the test results of recovery of distillable oils from agglomerates of subbituminous coal I (Table 1), subbituminous coal II (Table 2) and, as a comparison, from a thermal bituminous coal (Table 3). The deoiling process was conducted in three different ways; firstly under reduced pressure, secondly under atmospheric pressure using nitrogen as a carrier gas, and thirdly under atmospheric pressure using steam. Three temperatures were used 250° C., 300° C. and 350° C. As may be seen from the tables, while thermal treatment of agglomerates from thermal bituminous coal reduced the moisture capacity by only about 3%, for agglomerates from subbituminous coals (Tables 1 and 2), this reduction amounted to 7.1 and 5.6% units compared to the agglomerates. In general, the highest recovery of oil resulted from subbituminous coal and the use of steam at a temperature of 350° (Tables 1 and 2). The results presented in Tables 1 and 2 revealed that heat treatment and de-oiling process of present invention did not result in a significant decrease in the heating capacity of agglomerates for subbituminous coals.

TABLE 1

Recovery of Distillable Oils from Subbituminous Coal I Agglomerates by Heat Treatment

| | Temp. (°C.) | Oil Recovery (%): Weight loss of Aggl.[a] | Oil Recovery (%): Direct determination of condensed oil | Product Characteristics: VM[b] (%) | Product Characteristics: Moisture Capacity (%) | Product Characteristics: Calorific Value[b] Btu/lb |
|---|---|---|---|---|---|---|
| | — | — | — | 49.6 | 20.9 | 12,280 |
| | 250 | 38.4 | 33.5 | 45.1 | 15.4 | 12,280 |
| Reduced | 300 | 43.1 | 38.3 | 44.1 | 14.4 | 12,340 |
| Pressure | 350 | 78.3 | 63.9 | 39.4 | 12.7 | 12,400 |
| Nitrogen | 250 | 36.3 | 32.6 | 45.4 | 16.4 | 12,220 |
| Atmo- | 300 | 52.2 | 47.0 | 43.5 | 15.0 | 12,220 |
| sphere | 350 | 65.2 | 59.4 | 40.9 | 13.7 | 12,350 |
| Steam | 250 | 28.8 | 35.3 | 46.1 | 16.1 | 12,120 |
| Atmo- | 300 | 51.7 | 53.5 | 43.5 | 14.6 | 12,200 |
| sphere | 350 | 76.9 | 78.2 | 41.5 | 13.8 | 12,260 |

[a]Corrected for weight loss determined for coal samples treated under identical conditions; for experiments with steam weight loss of coal was corrected for non-condensable products only.

[b]Dry basis

VM = Volatile Matter

TABLE 2

Recovery of Distillable Oils from Subbituminous Coal II Agglomerates by Heat Treatment

| | Temp. (°C.) | Oil Recovery (%): Weight loss of Aggl.[a] | Oil Recovery (%): Direct determination of condensed oil | Product Characteristics: VM[b] (%) | Product Characteristics: Moisture Capacity (%) | Product Characteristics: Calorific Value[b] Btu/lb |
|---|---|---|---|---|---|---|
| | — | — | — | 48.6 | 13.0 | 13,350 |
| | 250 | 19.2 | 16.3 | | | |
| Reduced | 300 | 35.1 | 34.7 | 45.0 | 7.2 | 13,200 |
| Pressure | 350 | 53.6 | 51.7 | 41.4 | 6.2 | 13,250 |
| Nitrogen | 250 | 37.9 | 33.0 | 44.6 | 8.8 | 13,170 |
| Atmo- | 300 | 42.5 | 39.0 | 43.7 | 8.4 | 13,150 |
| sphere | 350 | 63.0 | 56.5 | 41.5 | 7.3 | 13,130 |
| Steam | 250 | 19.9 | 24.1 | 44.8 | 8.1 | 13,100 |
| Atmo- | 300 | 39.6 | 42.7 | 42.8 | 9.3 | 12,910 |
| sphere | 350 | 55.0 | 62.0 | 40.8 | 7.4 | 12,990 |

[a]Corrected for weight loss of coal under identical conditions of thermal treatment; for experiments with steam weight loss of coal was corrected for non-condensable products only.

[b]Dry basis

VM = Volatile Matter

TABLE 3

Recovery of Distillable Oils from Thermal Bituminous Coal Agglomerates by Heat Treatment

| | Temp. (°C.) | Oil Recovery (%): Weight loss of Aggl.[a] | Oil Recovery (%): Direct determination of condensed oil | Product Characteristics: VM[b] (%) | Product Characteristics: Moisture Capacity (%) | Product Characteristics: Calorific Value[b] Btu/lb |
|---|---|---|---|---|---|---|
| | — | — | — | 46.0 | 5.9 | 14,070 |
| | 250 | 14.9 | 14.9 | 44.9 | 4.0 | 13,850 |
| Reduced | 300 | 39.5 | 39.5 | 43.0 | 2.8 | 13,550 |
| Pressure | 350 | 51.6 | 45.3 | 42.6 | 2.5 | 13,620 |
| Nitrogen | 250 | 35.6 | 34.9 | 43.8 | 3.9 | 13,690 |
| Atmo- | 300 | 52.5 | 49.9 | 42.3 | 3.5 | 13,600 |
| sphere | 350 | 61.5 | 65.0 | 41.1 | 2.9 | 13,610 |
| Steam | 250 | 31.2 | 35.0 | 43.4 | 3.6 | 13,670 |
| Atmo- | 300 | 47.1 | 51.2 | 42.4 | 3.4 | 13,490 |
| sphere | 350 | — | 83.0 | 40.6 | 2.8 | 13,560 |

[a]Corrected for weight loss of coal under identical conditions of thermal treatment; for experiments with steam weight loss of coal was corrected for non-condensable products only.

[b]Dry basis

VM = Volatile Matter

What is claimed is:

1. A method for separating substantially deashed coal agglomerates generated from finely divided raw subbituminous coal by using low quality bridging liquids to form a solid made of de-oiled agglomerates and a liquid made of distillable hydrocarbons, comprising the step of contacting said agglomerates with steam and/or nitrogen gas at a temperature in the range of 250° to 350° C. at substantially atmospheric pressure, whereby the resultant separated solid contains less than about 7% by weight residual bridging liquid and is characterized by a moisture capacity reduced by at least 5% at a relative humidity of 96% compared to the moisture capacity of said agglomerates.

2. A method according to claim 1 wherein said step is conducted with steam.

3. A method according to claim 1 wherein said bridging liquid comprises a mixture of 50–80 wt % heavy oil and 20 to 50 wt % diesel oil.

4. A method according to claim 1 wherein said resultant separated solid fuel contains from 3 to 7% by weight residual bridging liquid.

* * * * *

UNITED STATES PATENT AND TRADEMARK OFFICE

CERTIFICATE OF CORRECTION

PATENT NO. : 4,854,940

DATED : August 8, 1989

INVENTOR(S) : Jerzy S. Janiak, et al

It is certified that error appears in the above-indentified patent and that said Letters Patent is hereby corrected as shown below:

Column 1, line 5, insert before the first paragraph --This invention was made with Government support under Contract No. DE-FG22-87PC79865 awarded by the Department of Energy. The Government has certain rights in this invention.--.

Signed and Sealed this

Twenty-sixth Day of April, 1994

*Attest:*

Bruce Lehman

BRUCE LEHMAN

*Attesting Officer*

*Commissioner of Patents and Trademarks*